US005769220A

United States Patent [19]

Hong

[11] Patent Number: 5,769,220

[45] Date of Patent: Jun. 23, 1998

[54] SECTIONAL GOLF BAG

[76] Inventor: Bum-ki Hong, 105-903, Hyundai first APT, 653 Gaepo-dong, Kangnam-gu, Seoul, Rep. of Korea

[21] Appl. No.: 840,488

[22] Filed: Apr. 21, 1997

[51] Int. Cl.[6] ..... A63B 55/00

[52] U.S. Cl. ..... 206/315.3; 206/315.8

[58] Field of Search ..... 206/315.2, 315.3, 206/315.4, 315.8

[56] References Cited

U.S. PATENT DOCUMENTS

| | | | |
|---|---|---|---|
| 1,581,061 | 4/1926 | Johnston | 206/315.2 X |
| 2,482,372 | 9/1949 | Rossow | 206/315.2 |
| 2,507,249 | 5/1950 | Dorazio | 206/315.8 |
| 3,678,072 | 7/1972 | Shuto | 206/315.6 |
| 3,901,299 | 8/1975 | Picco | 206/315.4 |
| 4,227,559 | 10/1980 | Stroman | 206/315.2 X |
| 4,249,586 | 2/1981 | Setani | 206/315.4 |
| 4,266,589 | 5/1981 | Cochran | 206/315.3 |
| 4,378,039 | 3/1983 | Suk | 206/315.8 |
| 5,544,743 | 8/1996 | Hong | 206/315.8 X |

*Primary Examiner*—Sue A. Weaver
*Attorney, Agent, or Firm*—Abelman, Frayne & Schwab

[57] ABSTRACT

A sectional golf bag is disclosed. The golf bag consists of a top frame, a bottom frame, a bag body, a ratchet bolt unit, a T-shaped bolt unit and a reinforcement unit. The golf bag is easily assembled and disassembled by a user so that it is easy to clean the interior of the bag while using the bag. The top and bottom frames are detachably attached to the top and bottom edges of the bag body using both bolt units so that it is not required to seam the top and bottom frames to the bag body differently from typical golf bags. The sectional golf bag is disassembled while being transported or stored in a golf shop or a warehouse for marketing and being kept in a user's house for a long time. The sectional golf bag thus remarkably reduces the volume and conserves storing space, thus allowing a merchandiser to store the golf bags in his shop in large numbers.

3 Claims, 6 Drawing Sheets

SECTIONAL GOLF BAG

BACKGROUND OF THE INVENTION

1. Field of the Invention

The present invention relates, in general, to golf bags and, more particularly, to a sectional (knockdown) golf bag suitable for being easily assembled and disassembled by a user or a merchandiser, thus being almost completely prevented from damage while being transported or marketed, and remarkably reducing the volume when it is disassembled, thus being stored in a limited space of a golf shop or of a warehouse in great numbers.

2. Description of the Prior Art

As well known to those skilled in the art, most typical golf bags individually have a straight, longish and upright configuration with an openable top suitable for keeping both a plurality of longitudinal clubs, having respective uses, and other golfing equipment. Such a golf bag is typically made of natural or synthetic leather and is transported and marketed in the state of an integrated structure with the seamed body, shoulder belt(s) and pockets being integrated together into a single structure.

The bag body, shoulder belt(s) and pockets of a typical golf bag, made of natural or synthetic leather, are integrated together through a sewing process so that competitiveness (expected life span, price and operational reliability) of the golf bag is mainly influenced by the conditions of the seamed joints. Therefore, most users or golfers try to carefully check the seamed portions of golf bags prior to selecting a bag to his liking.

It is necessary for empty golf bags to maintain their configurations without being deformed even though they are pressed by another object during transportation or marketing. In order to achieve the above object, the golf bags have to be transported while bulging with volumed interior holders such as paper or sponge holders. However, such volumed interior holders are problematic in that they cause waste of material and environmental pollution. The holders also have to be manually filled in empty bags one by one so that the filling of such holders into the bags wastes labor and is time consuming.

Another problem experienced while transporting or marketing such golf bags is that the bulging bags with the interior holders waste space. It is thus difficult to transport or store the bags in a golf shop or in a warehouse in great numbers. In addition, the golf bags may be regrettably deformed when they are pressed down during transportation and marketing.

When the golf bags are stored in a golf shop or in a warehouse with the interior holders being removed from the bags, the bags require large storage space since it is not easy to bend or fold the bags into compact sizes because the natural or synthetic leather bags have a considerable structural strength.

SUMMARY OF THE INVENTION

Accordingly, the present invention has been made keeping in mind the above problems occurring in the prior art, and an object of the present invention is to provide a golf bag, which has a knockdown structure suitable for being easily assembled and disassembled by a user or a merchandiser and remarkably reduces the volume when it is disassembled, thus being stored in a limited space of a golf shop or of a warehouse in great numbers.

In order to accomplish the above object, the present invention provides a sectional golf bag comprising a top frame forming an opening top of the golf bag, a bottom frame forming the bottom of the golf bag, a bag body with a ratchet bolt unit and a T-shaped bolt unit, and a reinforcement unit. The top frame includes a clip holder on the exterior side wall, a rectangular sleeve holder on the interior side wall and a T-shaped clip on the interior side wall at a position opposite to the sleeve holder. The sleeve holder comprises a rectangular guide sleeve and a ratchet sleeve abutting on one exterior side wall of the guide sleeve. The bottom frame includes a clip holder, a rectangular sleeve holder and a T-shaped clip, which respectively have the same constructions as those of the top frame and are formed at positions corresponding to those of the top frame. The bag body has a predetermined thickness and is selectively assembled with the top and bottom frames into a single body. The bag body includes a belt-attached vertical clip selectively engaging with each of the clip holders of the top and bottom frames, a belt-attached horizontal clip provided at a position suitable for surrounding a belt of the vertical clip and a belt-attached holder selectively engaging with the horizontal clip thus tightening the bag body when the bag body is assembled with the top and bottom frames. Both the ratchet bolt unit and the T-shaped bolt unit are interiorly provided on each of the top and bottom edges of the bag body and selectively engage with both the sleeve holder and the T-shaped clip of each of the top and bottom frames respectively, thus assembling the bag body with the top and bottom frames into a single body. The reinforcement unit interiorly and vertically extends from each of the bolt units provided on the top edge of the bag body to each of the bolt units provided on the bottom edge of the bag body thus reinforcing the bag body. The reinforcement unit includes a longitudinal holder having an axial opening and a longitudinal pipe passing through the opening of the longitudinal holder. The pipe is fitted into each of the bolt units at each end thereof.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
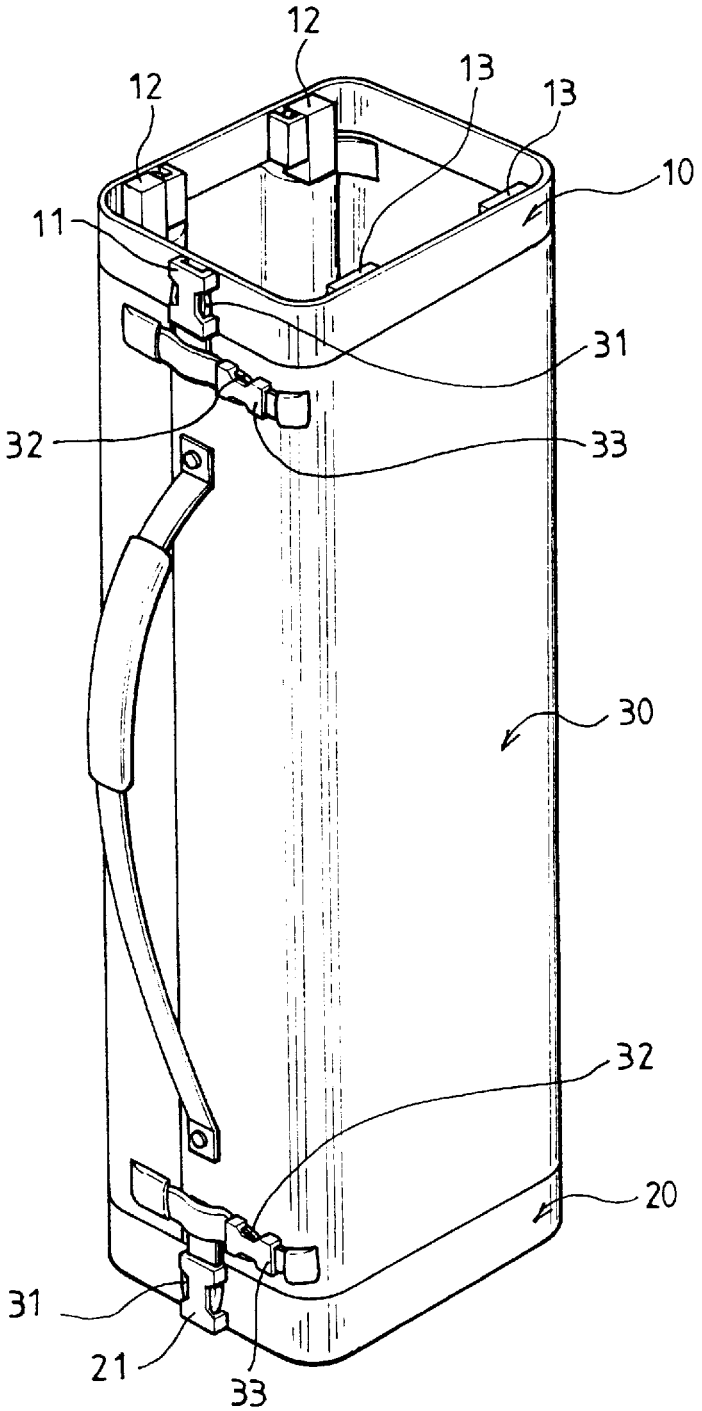
FIG. 1 is a perspective view of an assembled sectional golf bag in accordance with the preferred embodiment of the present invention.
Figure 2:
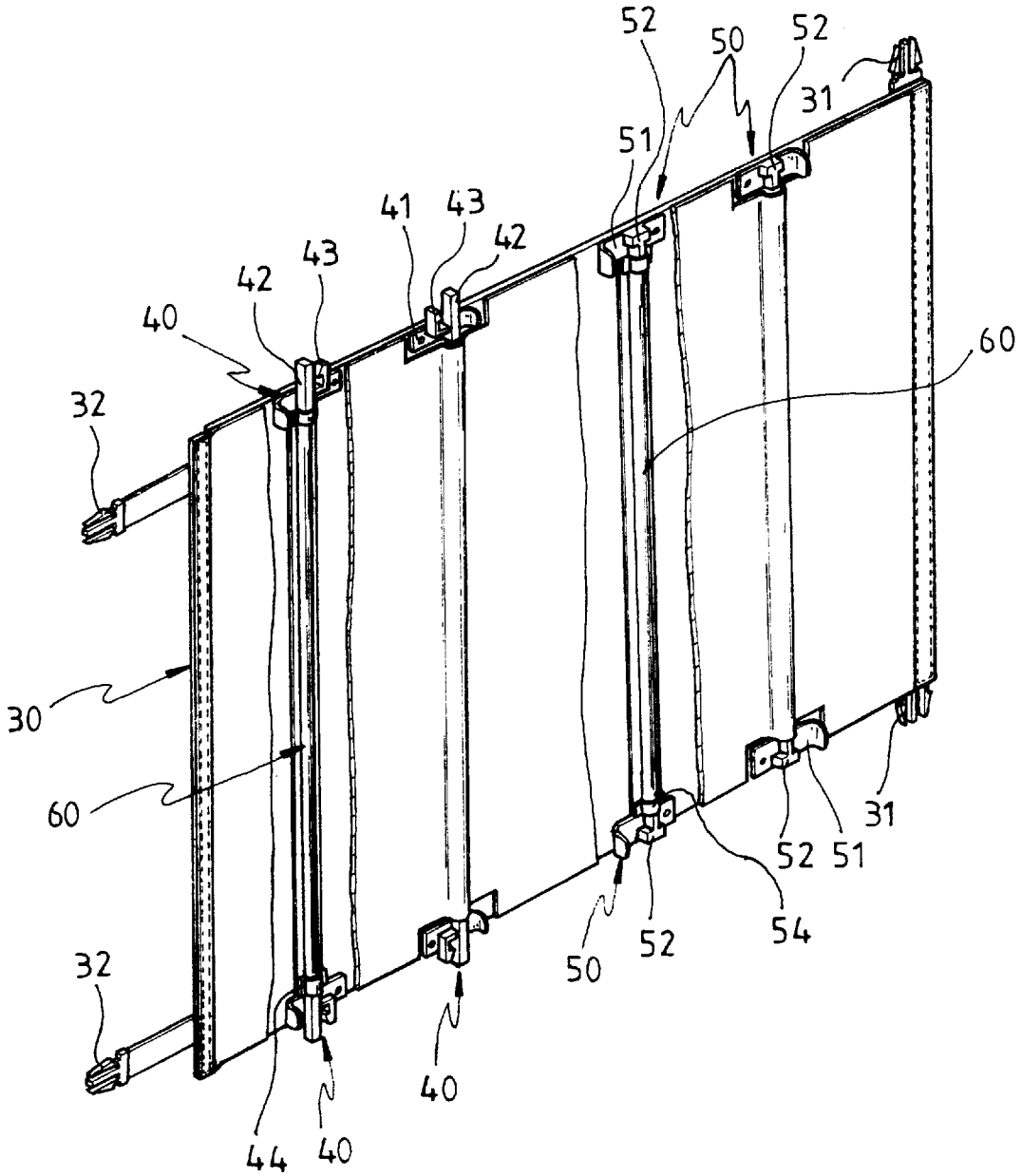
FIG. 2 is a perspective view of a developed bag body of the sectional golf bag of this invention.
Figure 3:
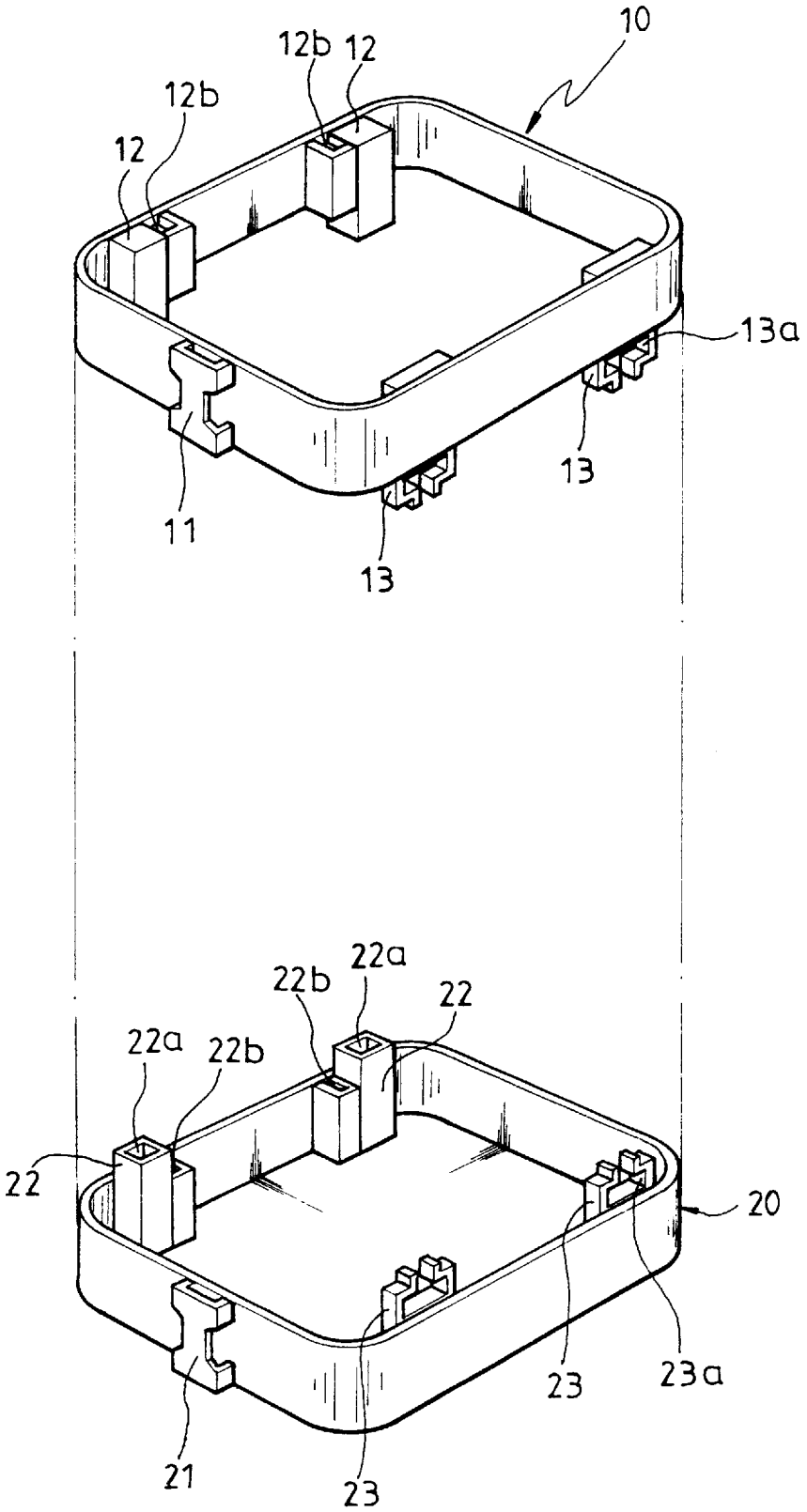
FIG. 3 is a perspective view of top and bottom frames of the above golf bag.
Figure 4A:
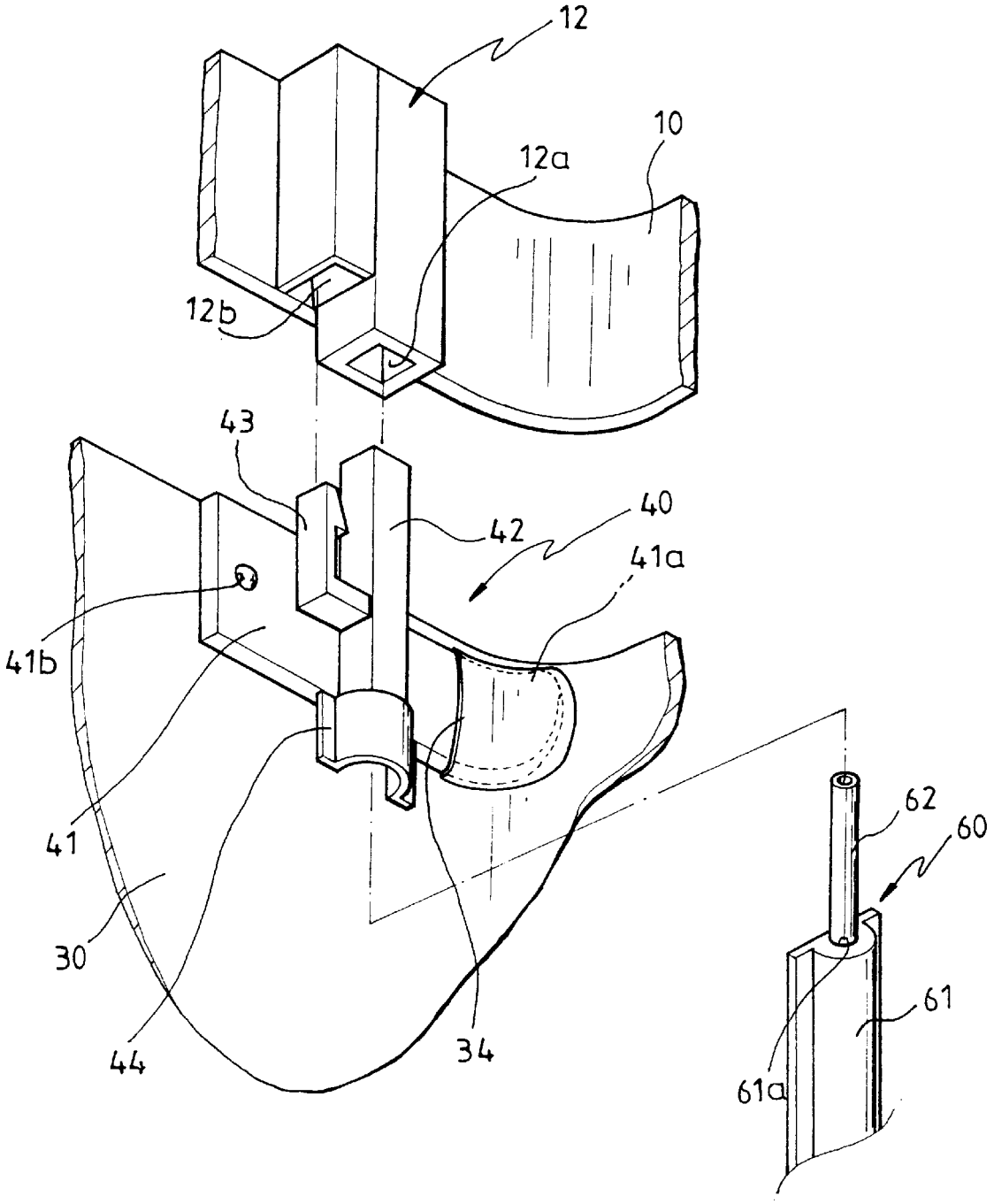
FIGS. 4*a* and 4*b* are perspective views showing the operation of two types of coupling units used for assembling the bag body with the top frame into a single body in accordance with the invention.
Figure 4B:
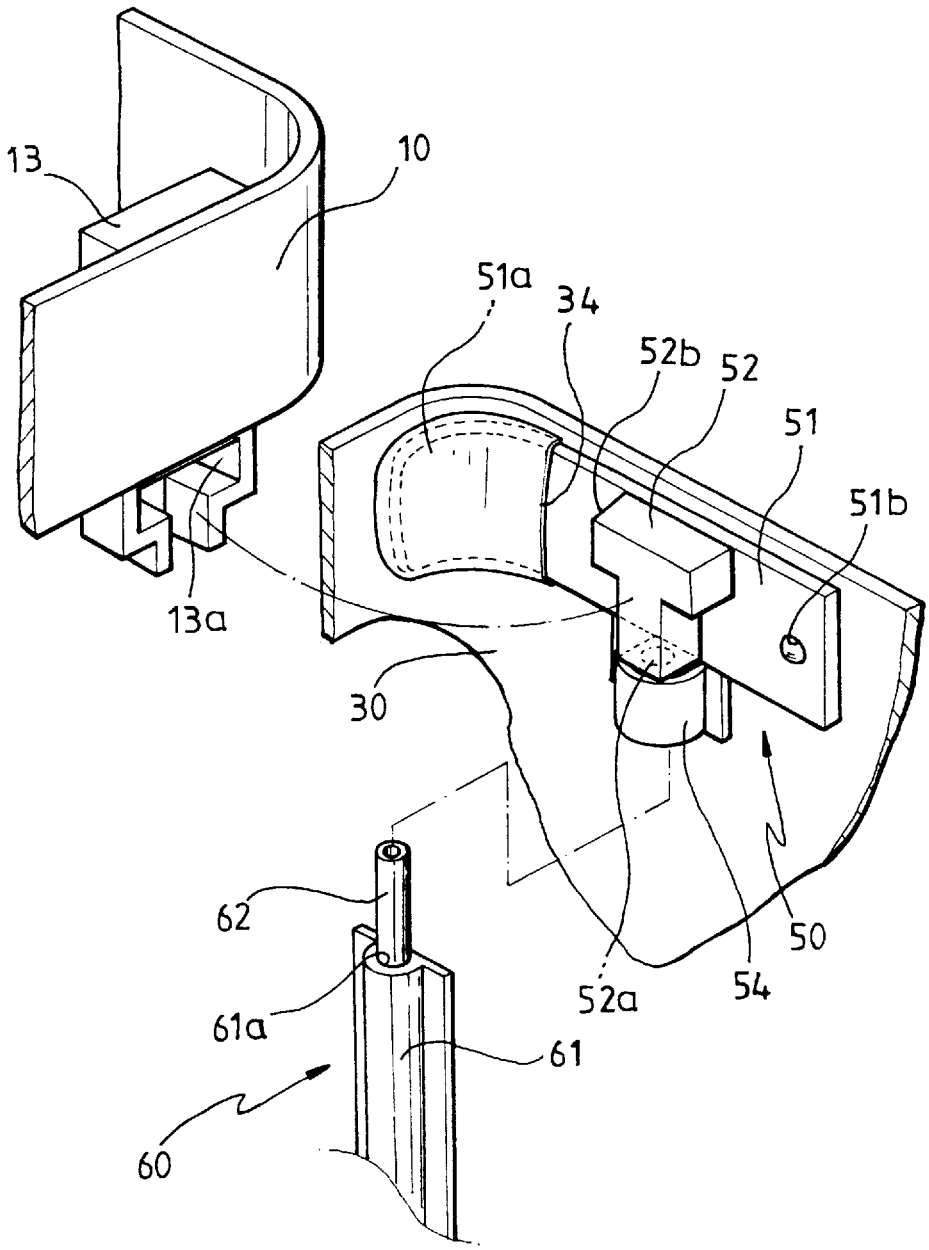
Figure 5:
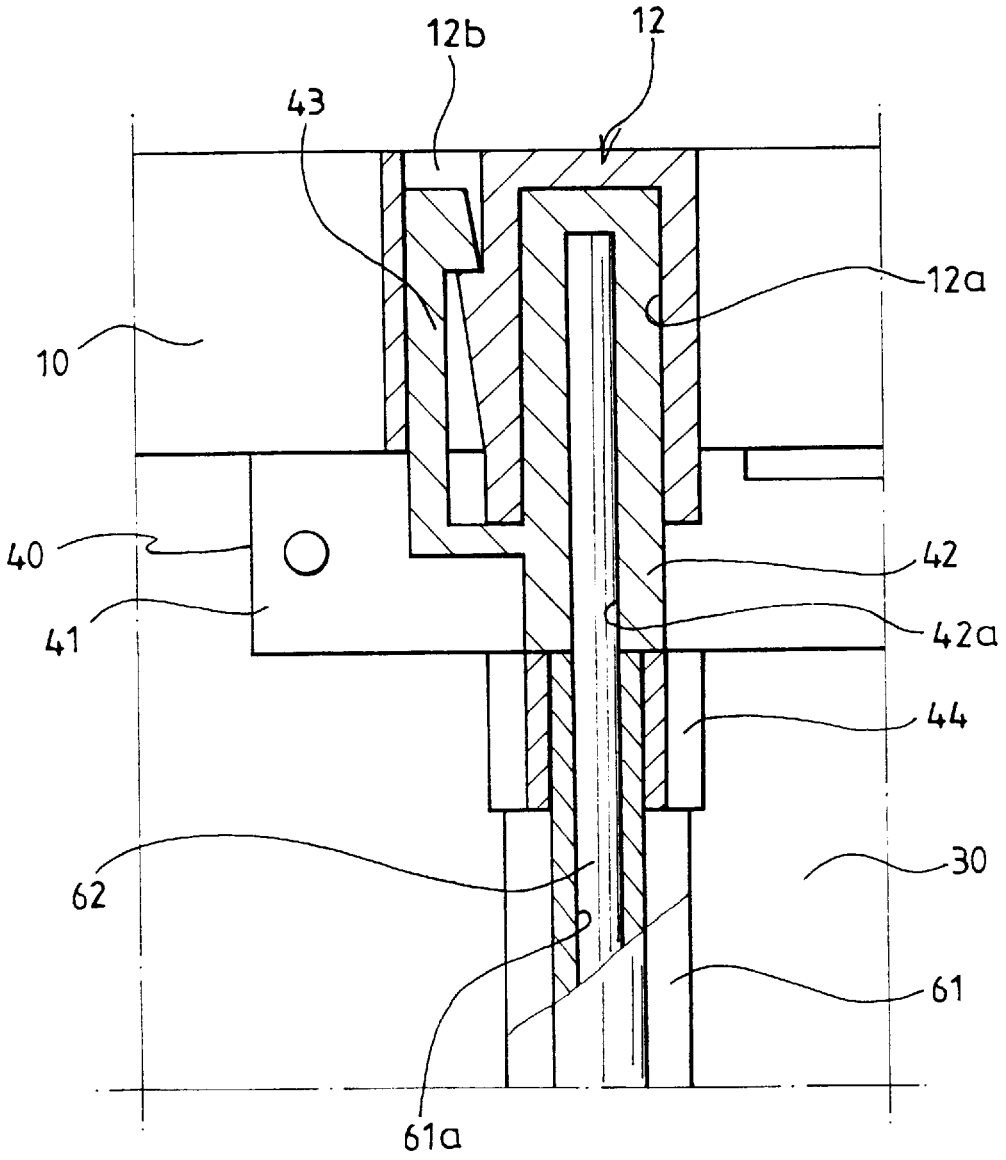
FIG. 5 is a sectional view of the coupling unit of FIG. 4*a* after the bag body is assembled with the top frame into a single body.

FIG. 1 is a perspective view of an assembled sectional golf bag according to the preferred embodiment of this invention. FIG. 2 is a perspective view of a developed bag body of the sectional golf bag. FIG. 3 is a perspective view of top and bottom frames of the sectional golf bag. FIGS. 4*a* and 4*b* show the operation of two types of coupling units used for assembling the bag body with the top frame into a single body. FIG. 5 is a sectional view of the coupling unit of FIG. 4*a* after the bag body is assembled with the top frame into a single body.

As shown in the drawings, the sectional golf bag of this invention generally comprises three separable parts: a top frame 10, a bottom frame 20 and a bag body 30. The top frame 10 has a generally-rectangular configuration and includes one clip holder 11 on the exterior side wall and two rectangular sleeve holders 12 on the interior side wall. The top frame 10 also has two T-shaped clips 13 on the interior side wall at positions opposite to the sleeve holders 12. Each of the sleeve holders 12 comprises two rectangular sleeves: a vertical guide sleeve 12*a* having a rectangular cross-section and a ratchet sleeve 12*b* abutting on one exterior side wall of the guide sleeve 12*a*. In the present invention,. the top frame 10, clip holder 11, two sleeve holders 12 and two T-shaped clips 13 are preferably formed into a single structure. Similarly, the bottom frame 20, which forms the bottom of the golf bag, includes one clip holder 21, two sleeve holders 22 and two T-shaped clips 23, which have the same configurations as those of the top frame 10 and are formed on the positions corresponding to those of the top frame 10. Each sleeve holder 22 of the bottom frame 20 comprises two rectangular sleeves: a vertical guide sleeve 22*a* and a ratchet sleeve 22*b* in the same manner as described for the top frame 10. The construction of the top and bottom frames 10 and 20 are best shown in FIG. 3.

Meanwhile, when the bag body 30 with a predetermined thickness is fully opened as shown in FIG. 2, the length of the body 30 meets the circumference of each of the top and bottom frames 10 and 20. Two resilient vertical clips or first clips 31, individually having a flexible belt, are attached to predetermined positions of the top and bottom edges of the body 30 so that the clips 31 engage with the clip holders 11 and 21 of the top and bottom frames 10 and 20. The bag body 30 also has two resilient horizontal clips or second clips 32, which individually have a flexible belt and are attached to top and bottom portions of one side edge of the body 30. The bag body 30 further includes two clip holders 33 on the other side edge at positions corresponding to the second clips 32. The second clips 32 engage with the clip holders 33 thus tightening the bag body 30 wrapping around the top and bottom frames 10 and 20.

In the present invention, the first and second clips 31 and 32, two clip holders 33 and a shoulder belt are preferably attached to the bag body 30 through a sewing process.

The bag body 30 also has a means for assembling the body 30 to the top and bottom frames 10 and 20. That is, the bag body 30 has two ratchet bolt units 40 and two T-shaped bolt units 50 on each of the top and bottom edges. When the bag body 30 is integrated with the top frame 10, the two types of bolt units 40 and 50 provided on the top edge of the body 30 engage with the sleeve holders 12 and T-shaped clips 13 of the top frame 10, respectively. In the same manner, the two types of bolt units 40 and 50 provided on the bottom edge of the bag body 30 engage with the sleeve holders 22 and T-shaped clips 23 of the bottom frame 20 respectively, when the bag body 30 is integrated with the bottom frame 20. In the bag body 30, a reinforcement unit 60 vertically extends from each bolt unit 40, 50 of the top edge to an associated bolt unit 40, 50 of the bottom edge, thus reinforcing the body 30. Each reinforcement unit 60 comprises a longitudinal holder 61 having an axial opening 61*a*. A longitudinal pipe 62, having a predetermined diameter and length, passes through the opening 61*a* of the holder 61 and is fitted into the bolt units 40, 50 at the top and bottom ends.

Each of the ratchet bolt units 40 comprises a bracket plate 41 having a predetermined thickness and width. The bracket plate 41 has a rounded portion 41*a* at one end and a rivet hole 41*b* at the other end. A vertical guide bolt 42, having a rectangular cross-section, is integrated with the center of the bracket plate 41. A pipe fitting hole 42*a*, having a predetermined depth, is axially formed on the bottom of the guide bolt 42. A ratchet bolt 43 is branched from one side wall of the guide bolt 42 and extends in parallel to the guide bolt 42, with a gap being formed between the two bolts 42 and 43. Each of the ratchet bolt units 40 also includes an arcuate holder 44, which is formed on the bottom edge of the bracket plate 41 at a position approximate to the lower end of the guide bolt 42 and holds the reinforcement unit 60. The construction of the ratchet bolt unit 40 is shown in FIGS. 4*a* and 5 in detail.

Meanwhile, each of the T-shaped bolt units 50 comprises a bracket plate 51 having a predetermined thickness and width. The bracket plate 51 has a rounded portion 51*a* at one end and a rivet hole 51*b* at the other end. A vertical T-shaped bolt 52 is integrated with the center of the bracket plate 51. A pipe fitting hole 52*a*, having a predetermined depth, is axially formed on the bottom of the T-shaped bolt 52. Each of the T-shaped bolt units 50 also includes an arcuate holder 54, which is formed on the bottom edge of the bracket plate 51 at a position approximate to the lower end of the T-shaped bolt 52 and holds the reinforcement unit 60. The construction of the T-shaped bolt unit 50 is shown in FIG. 4*b*.

In order to attach the bracket plate 41, 51 of each bolt unit 40, 50 to the inside wall of the bag body 30, a holding pocket 34 is fixed to the body 30 and receives the rounded portion 41*a*, 51*a* of the plate 41, 51. That is, the holding pocket 34 cooperates with a rivet (not shown), which is placed in the rivet hole 41*b*, 51*b* of the plate 41, 51, thus attaching the plate 41, 51 to the bag body 30.

The opposite top side ends of each T-shaped bolt 52 and associated portions of each T-shaped clip 13, 23 are inclined at an angle of inclination, thus forming sloping surfaces 52*b*, 13*a*, 23*a*. Due to such sloping surfaces 52*b*, 13*a*, 23*a*, the T-shaped bolt 52 is smoothly fitted into the T-shaped clip 13, 23 without causing any interference between them.

The operational effect of the above sectional golf bag will be described hereinbelow.

In order to assemble the top and bottom frames 10 and 20 with the bag body 30 into a single structure, two ratchet bolt units 40 and two T-shaped bolt units 50 are primarily arranged on the top interior edge of the bag body 30 at predetermined positions corresponding to the two sleeve holders 12 and two T-shaped clips 13 of the top frame 10. Thereafter, each bolt unit 40, 50 is fixed to the bag body 30 by rivetting the unit 40, 50 on the body 30 using a rivet (not shown) passing through the rivet hole 41*b*, 51*b* of the bracket plate 41, 51.

Of course, the rounded portion 41*a*, 51*a* of the bracket plate 41, 51 of each bolt unit 40, 50 has to be received in a pocket holder 34 of the bag body 30 prior to rivetting the bolt unit 40, 50 on the bag body 30.

In addition, the holder 61 of each reinforcement unit 60 is fitted into the arcuate holder 44, 54 of each bolt unit 40, 50 at the top end. In this case, the top end of the longitudinal pipe 62 of each reinforcement unit 60 is inserted into the pipe fitting hole 42*a*, 52*a* of each bolt 42, 52.

The reinforcement units 60 prevent a horizontal deformation of the golf bag relative to the vertical direction of the bag and maintain the upright configuration of the bag body 30.

After the two types of bolt units 40 and 50 are fixed to the top edge of the bag body 30 as described above, two ratchet bolt units 40 and two T-shaped bolt units 50 are fixed to the bottom edge of the body 30 as will be described hereinbelow.

That is, two ratchet bolt units 40 and two T-shaped bolt units 50 are arranged on the bottom interior edge of the bag body 30, with the holder 61 of each reinforcement unit 60 being fitted into the arcuate holder 44, 54 of each bolt unit 40, 50 at the bottom end. In this case, the bottom end of the longitudinal pipe 62 of each reinforcement unit 60 is inserted into the pipe fitting hole 42*a*, 52*a* of each bolt 42, 52. In addition, the rounded portion 41*a*, 51*a* of the bracket plate 41, 51 of each bolt unit 40, 50 has to be received in a pocket holder 34 of the bag body 30 prior to rivetting the bolt unit 40, 50 on the bag body 30. Thereafter, each bolt unit 40, 50 is fixed to the bag body 30 by rivetting the unit 40, 50 on the body 30 using a rivet (not shown) passing through the rivet hole 41*b*, 51*b* of the bracket plate 41, 51.

After the bolt units 40 and 50 are fixed to the top and bottom edges of the bag body 30, the bag body 30 is assembled with the top and bottom frames 10 and 20 into a single structure as follows.

First, the two frames 10 and 20 are preliminarily attached to the top and bottom edges of the bag body 30 by inserting the first clips 31 of the bag body 30 into the clip holders 11 and 21 of the top and bottom frames 10 and 20. Thereafter, the two ratchet bolt units 40 and two T-shaped bolt units 50 provided on the top edge of the bag body 30 tightly engage with the two sleeve holders 12 and two T-shaped clips 13 of the top frame 10 respectively so that the top frame 10 is finally attached to the top edge of the bag body 30. In the same manner, the two ratchet bolt units 40 and two T-shaped bolt units 50 provided on the bottom edge of the bag body 30 tightly engage with the two sleeve holders 22 and two T-shaped clips 23 of the bottom frame 20 respectively so that the bottom frame 20 is finally attached to the bottom edge of the bag body 30.

If described in detail, the guide bolt 42 of each ratchet bolt unit 40 of the bag body 30 is fully inserted into the guide sleeve 12*a*, 22*a* of each sleeve holder 12, 22 of a frame 10, 20 so that the ratchet bolt 43 of each ratchet bolt unit 40 is elastically snapped into the ratchet sleeve 12*b*, 22*b* of each sleeve holder 12, 22. Therefore, the ratchet bolt units 40 completely engage with the sleeve holders 12 and 22 of the top and bottom frames 10 and 20. One ratchet bolt unit 40, engaging with an associated sleeve holder 12 of the top frame 10, is shown in the sectional view of FIG. 3.

In this case, it is preferable to engage the ratchet bolt units 40 with the sleeve holders 12 and 22 of the top and bottom frames 10 and 20 at the same time. Thereafter, the T-shaped bolt units 50 of the bag body 30 engage with the T-shaped clips 13 and 23 of the top and bottom frames 10 and 20. That is, the T-shaped bolt 52 of each T-shaped bolt unit 50 is fully inserted into each T-shaped clip 13, 23, with the sloping surfaces 13*a*, 23*a* of each clip 13, 23 guiding the sloping surfaces 52*b* of each T-shaped bolt 52.

In this case, the sloping surfaces 13*a*, 23*a* of each clip 13, 23 smoothly guide the sloping surfaces 52*b* of each T-shaped bolt unit 50 without causing any interference in the junction. Due to both the T-shaped clips 13 and 23 and the T-shaped bolt units 50, the top and bottom edges of the bag body 30 are brought into close contact with the bottom and top edges of the two frames 10 and 20, respectively. Therefore, the bag body 30 is tightly and neatly assembled with the top and bottom frames 10 and 20 into a golf bag.

Thereafter, the top and bottom second clips 32, provided on one side edge of the bag body 30, engage with associated clip holders 33 formed on the other side edge, thus tightening the bag body 30 wrapping around the top and bottom frames 10 and 20 and finishing the assembling of the sectional golf bag.

In the above state, the second clips 32, which are buckled with the clip holders 33, also tightly surround the belt portions of the first clips 31, thus strengthening the buckling force of each first clip 31 relative to the clip holder 11, 21. Therefore, the first clips 31 are almost completely free from unexpected removal from the clip holder 11, 21 even though tensile force is applied to the first clips 31 when a user walks with the golf bag on his shoulder.

When the assembled golf bag with a plurality of clubs and golfing equipment is used on a, green, the interior of the bag may be infiltrated and contaminated with soil or other foreign substances, requiring the interior of the bag to be at least partially opened for cleaning. In order to open the interior of the bag, the second clips 32 of the body 30 are primarily removed from the clip holders 33 prior to somewhat forcibly opening the body 30 from the top and bottom frames 10 and 20. In this case, the T-shaped bolt units 50 of the bag body 30 are removed from the T-shaped clips 13 and 23 of the frames 10 and 20, thus opening the interior of the bag and allowing a user to clean the interior.

As described above, the present invention provides a sectional golf bag. The golf bag of this invention is easily assembled and disassembled by a user so that it is easy to clean the interior of the bag while using the bag. In addition, the above sectional golf bag comprises three detachable parts so that a damaged one of the parts can be easily changed with a new one at low cost. The golf bag is thus convenient to a user.

In the sectional golf bag of this invention, a top frame is detachably attached to the top edge of a bag body using a detachable clamping means so that it is not required to seam the top frame onto the top edge of the bag body differently from a typical golf bag. The golf bag thus remarkably reduces the sewing steps in the process of producing the bag, thus reducing production costs and allowing the production process to be free from highly-skilled workers.

The sectional golf bag of this invention is disassembled while being transported or stored in a golf shop or a warehouse for marketing and being kept in a user's house for a long time. The sectional golf bag thus remarkably reduces the volume and conserves storing space, thus allowing a merchandiser to store the golf bags in his shop in large numbers.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A sectional golf bag comprising:

a top frame forming an opening top of said golf bag and including:

a clip holder on the exterior side wall;

a rectangular sleeve holder on the interior side wall, said sleeve holder comprising a rectangular guide sleeve and a ratchet sleeve abutting on one exterior side wall of said guide sleeve; and a T-shaped clip on the interior side wall at a position opposite to said sleeve holder;

a bottom frame forming, the bottom of said golf bag and including a clip holder, a rectangular sleeve holder and a T-shaped clip, said clip holder, sleeve holder and T-shaped clip of the bottom frame respectively having the same constructions as those of the top frame and being formed at positions corresponding to those of the top frame;

a bag body having a predetermined thickness and being selectively assembled with said top and bottom frames into a single body, said bag body including:

a belt-attached vertical, clip selectively engaging with each of the clip holders of the top and bottom frames;

a belt-attached horizontal clip provided at a position suitable for surrounding a belt of said vertical clip; and a belt-attached holder selectively engaging with said horizontal clip, thus tightening the bag body when the bag body is assembled with the top and bottom frames;

a ratchet bolt unit and a T-shaped bolt unit, both bolt units being interiorly provided on each of the top and bottom edges of said bag body and selectively engaging with both the sleeve holder and the T-shaped clip of each of the top and bottom frames respectively, thus assembling the bag body with the top and bottom frames into a single body; and a reinforcement unit interiorly and vertically extending from each of the bolt units provided on the top edge of the bag body to each of the bolt units provided on the bottom edge of the bag body thus reinforcing the bag body, said reinforcement unit including:

a longitudinal holder having an axial opening; and a longitudinal pipe passing through said opening of the longitudinal holder, said pipe being fitted into each of the bolt units at each end thereof.

2. The sectional golf bag according to claim 1, wherein said ratchet bolt unit comprises:

a bracket plate having a rounded portion at one end and a rivet hole at the other end, said rounded portion being received in a holding pocket of the bag body and said rivet hole receiving a rivet thus attaching the bracket plate to the bag body;

a rectangular guide bolt integrated with the center of said bracket plate and adapted for selectively engaging with the guide sleeve of each of the sleeve holders of the top and bottom frames, the bottom end of said guide bolt being provided with a pipe fitting hole for receiving each end of said longitudinal pipe of the reinforcement unit;

a ratchet bolt branched from one side wall of said guide bolt and extending in parallel to the guide bolt with a gap being formed between the two bolts, said ratchet bolt selectively engaging with the ratchet sleeve of each of the sleeve holders; and an arcuate holder formed on the bottom edge of said bracket plate at a position approximate to the lower end of said guide bolt and adapted for holding each end of the reinforcement unit.

3. The sectional golf bag according to claim 1, wherein said T-shaped bolt unit comprises:

a bracket plate having a rounded portion at one end and a rivet hole at the other end, said rounded portion being received in a holding pocket of the bag body and said rivet hole receiving a rivet thus attaching the bracket plate to the bag body;

a T-shaped bolt integrated with the center of said bracket plate and adapted for selectively engaging with each of the T-shaped clips of the top and bottom frames, the bottom end of said T-shaped bolt being provided with a pipe fitting hole for receiving each end of said longitudinal pipe of the reinforcement unit; and an arcuate holder formed on the bottom edge of said bracket plate at a position approximate to the lower end of said T-shaped bolt and adapted for holding each end of the reinforcement unit.

* * * * *